United States Patent [19]

Ponza

[11] Patent Number: 4,890,834

[45] Date of Patent: Jan. 2, 1990

[54] BATTING PRACTICE APPARATUS

[75] Inventor: Lorenzo J. Ponza, Santa Cruz, Calif.

[73] Assignee: Athletic Training Equipment Company, Clackamas, Oreg.

[21] Appl. No.: 44,344

[22] Filed: Apr. 30, 1987

Related U.S. Application Data

[63] Continuation of Ser. No. 727,610, Apr. 29, 1985, abandoned, which is a continuation of Ser. No. 363,031, Mar. 29, 1982, abandoned.

[51] Int. Cl.[4] ..... A63B 69/40

[52] U.S. Cl. ..... 273/26 R

[58] Field of Search ..... 273/26 A, 29 A, 26 D, 273/181 F; 198/663, 667, 677

[56] References Cited

U.S. PATENT DOCUMENTS

| | | | |
|---|---|---|---|
| 1,203,027 | 10/1916 | McMillan | 273/26 D |
| 1,923,297 | 8/1933 | Cooper | 273/26 R |
| 1,989,542 | 1/1935 | Boothman | 273/181 F |
| 3,222,067 | 12/1965 | Litwhiler et al. | 273/26 A |
| 3,980,304 | 9/1976 | O'Neill et al. | 273/26 R |
| 4,082,271 | 4/1978 | Martin | 273/29 A |

*Primary Examiner*—T. Brown

*Attorney, Agent, or Firm*—Paul B. Fihe

[57] ABSTRACT

Disclosed is a self-contained batting practice apparatus including a cage or enclosure preferably formed by resilient flexible material supported within an exterior frame so that a batted ball only engages a flexible surface. A ball throwing unit is arranged to throw a ball from one end of the cage to a batter positioned at the opposite end. A batted ball engages the flexible cage walls and drops to the bottom, which is sloped so that the ball rolls to an opening and drops therethrough to a conveyor system which recycles the ball to the throwing unit through a ball control unit which delivers the balls in timed sequence for repeated throws to the batter.

19 Claims, 4 Drawing Sheets fig_6
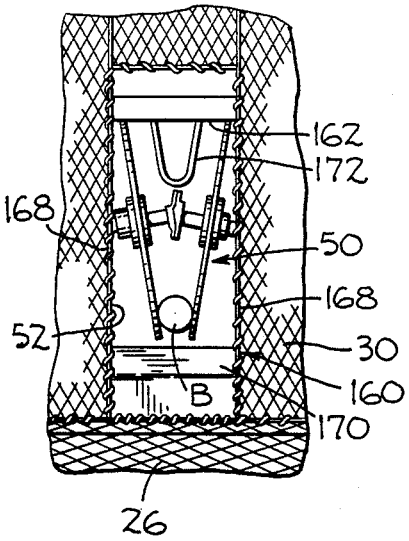
fig_5
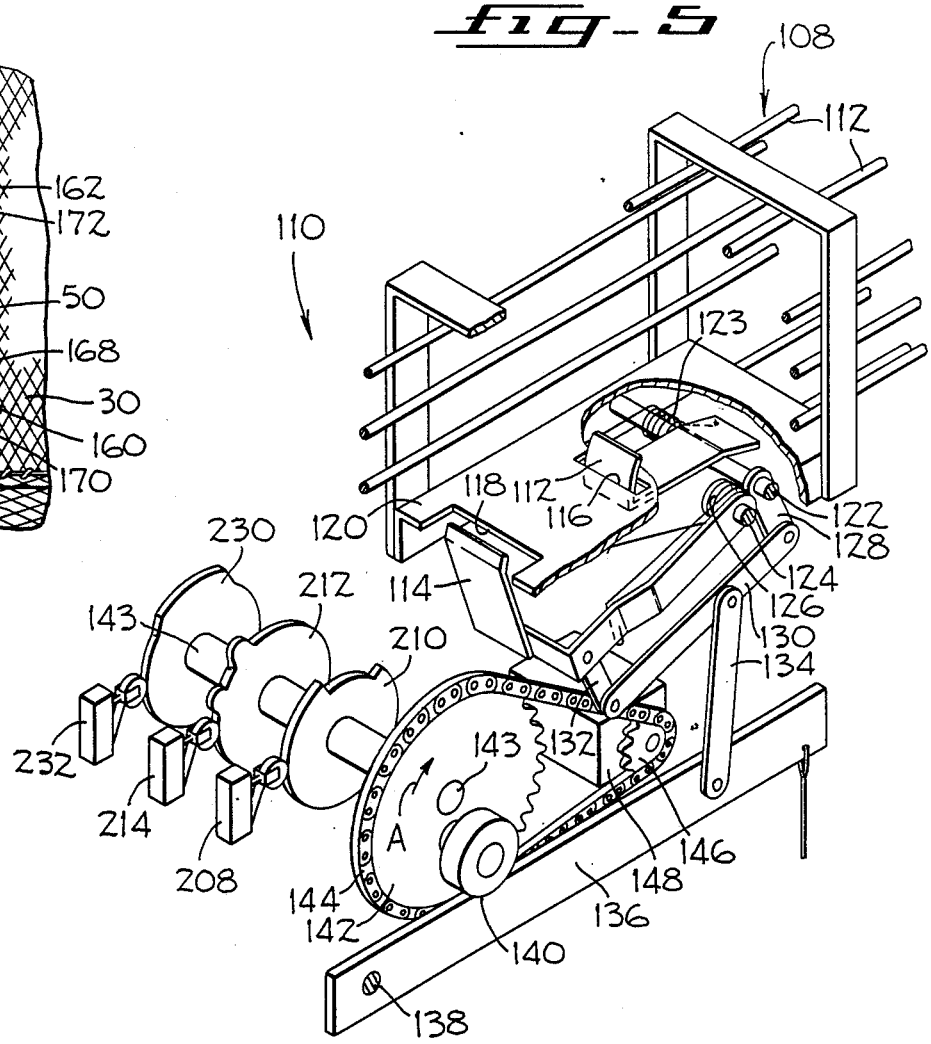
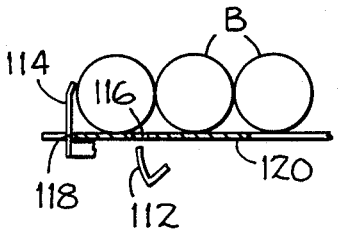
fig_5A
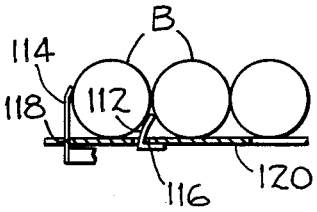
fig_5B
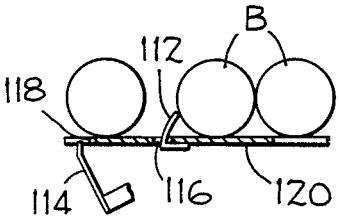
fig_5C

BATTING PRACTICE APPARATUS

This application is a continuation of application Ser. No. 06/727,610, filed Apr. 29, 1985 (ABANDONED) which is a continuation of application Ser. No. 363, 031, filed Mar. 29, 1982 (ABANDONED).

FIELD OF THE INVENTION

The present invention relates generally to batting practice apparatus, and more particularly, to an automatic batting practice apparatus wherein a ball can be thrown, batted, and then recycled for a repeat operation.

BACKGROUND OF THE INVENTION

For batting practice, a number of machines have been developed to throw balls in controlled sequence to a batter, one example being the machine shown in my prior U.S. Pat. No. 4,195,614. However, as will be apparent, the batted balls must be retrieved by players in the field and then manually returned to the throwing machine.

Attempts have been made to provide automatic retrieval and recycling equipment for the balls, but no satisfactory solution has been devised. Such equipment necessarily includes some form of restrictive enclosure, which commonly has been an expensive and permanent structure utilizing standard building techniques. Furthermore, such structures have included hard surfaces and edges, which cause damage to the recycled balls and limit their useful life. Furthermore, recycling of the balls to a throwing device seemingly requires complex mechanisms, which also are expensive and greatly enlarge the overall dimensions of the equipment.

SUMMARY OF THE PRESENT INVENTION

Accordingly, it is the general objective of the present invention to provide a self-contained batting practice apparatus which can be readily assembled or disassembled on any reasonably level site, indoors or outdoors, and includes a batting cage composed substantially entirely of flexible material so that each ball thrown can be batted and then recycled many times to a ball throwing unit.

To achieve such objective, a modular framework can be erected on any supporting surface such as a relatively flat area of ground, cement, or any other supporting surface. The framework consists of longitudinal, upright, and transverse frame members connected by simple telescopic insertion into rectangularly related sockets in frame couplers, no bolting or other complex assembly operations being required so that the framework can be erected or disassembled quickly and easily. The modular arrangement enables accommodation of different size structures for baseball or softball batting, with the requisite differences in the distance between the throwing and batting positions, and a plurality of the units can be installed, as required.

Entirely within the confines of the open framework a batting cage formed substantially entirely of flexible resilient material such as nylon netting is supported therefrom, the cage including a top, bottom, side walls and end walls. The cage elements are connected interiorly of the frame and thus exert a resilient inward force holding the frame members in their assembled relation to substantially obviate the necessity for bolted connections. Also, since the cage material is within the frame, no hard surfaces or edges are engaged by a batted ball whose useful life is thus considerably extended.

The framework also includes two longitudinally-extending side members disposed at a slight slope, to which side members the edges of the cage bottom are secured so that any balls dropping onto the bottom will roll under gravitational force toward one end of the cage. The cage bottom is formed by netting having openings substantially smaller than the ball diameter so as not to interfere with the ball motion. The rolling of each ball will be expedited when subsequent balls hit the cage bottom so as to exert a flexing of the resilient material resultant from the experienced impact.

At its lower end, the bottom is also centrally connected to the encompassing frame so that a transverse slope is also provided toward a central ball receiving opening. Such opening at the lowest portion of the cage bottom lies adjacent a slightly elevated batting platform which is marked "home plate" to indicate the strike zone and the batter's boxes on either side thereof.

Immediately beneath the opening in the cage bottom, one end of a special ball conveyor is arranged to receive balls, and in sequence convey the same laterally and slightly upwardly under the cage bottom to one side thereof, the slope of the cage bottom allowing such inclination of the lateral conveyor from a position close to the supporting surface for the entire framework to a slightly elevated position outside the frame contour where the conveyed balls can drop into a ball hopper.

Preferably, to minimize the lateral conveyor dimensions, it is formed by two parallel shafts having cords of corresponding helical configuration wound thereon so that, upon rotation by a suitable motor, balls will be advanced by the rotating shafts with the cords thereon. The pitch of the helical cords is greater than the largest expected ball diameter so the various balls can be accommodated. The more extensive vertical dimensions of a standard endless conveyor are thus avoided.

The ball hopper is formed by a grid of rigid rods, the bottom ones of which slope downwardly from the end of the lateral conveyor so that balls dropping into the hopper will roll downwardly to the outer end of the hopper. At this point, the side rods of the hopper are broken away, forming parallel vertical slots which accommodate two curved ball-pick-up fingers on the upward flight of a powered endless conveyor, which thus functions as a ball elevator.

The ball elevator is attached to the outside of a vertical frame member and rises to a point adjacent the top of the framework, where the elevated balls in sequence are delivered into a ball chute that slopes gradually downwardly along the side of the framework, and thence inwardly to a ball-throwing machine located at a central position at the end of the batting cage opposite the batter's position therein. The throwing machine is at a substantially lower level than the upper end of the ball elevator, and allows the slope of the chute to be sufficient to provide a gravity flow of balls therealong, thus obviating the need for additional extended powered ball conveyors.

Preferably, the ball-throwing machine takes the form described in detail in my prior U.S. Pat. No. 4,195,614, to which reference is made for details of its construction and operation. Suffice it to say for present purposes, such machine provides for adjustment of throwing speed and ball trajectory, both vertically and horizontally, and other machines having similar attributes can be utilized departing from the present inventive concepts.

As mentioned, the ball-throwing machine is mounted centrally of the end of the batting cage opposite the batter's position, but to avoid ball or machine damage, it is located exteriorly of the cage end wall adjacent an opening in such end wall, such opening being relatively small but of sufficient size to accommodate adjustments of the ball trajectory. Being rather small, the probability of a batted ball entering such opening is equally small, but a ball confining unit can be connected between the throwing machine and the end wall netting to preclude rethrowing of the batted ball and exit to the surrounding area.

As an alternative or addition to such ball confining unit, a protective screen of flexible netting can be positioned over the opening but removed from its screening position automatically when a ball is to be thrown, but immediately thereafter returned to its operative screening position.

At a position in the ball chute adjacent its terminus at the ball throwing machine, a ball control means is operatively arranged to feed a single ball at a predetermined time to the throwing machine for delivery thereby to the batter. Such control means includes a pair of pivoted gates positioned at an interval along the chute slightly in excess of one ball diameter The first gate encountered by a series of balls is normally open so that all of the balls can advance until the second gate is engaged. Periodically, the first gate is closed, leaving but one ball positioned between the two gates, and correlated but subsequent opening of the second gate allows gravitational motion of the single ball to the throwing machine for delivery to the batter.

The gate control means has an associated means for timed control of the screen opening previously mentioned, and preferably also actuates a signal, visual or auditory, to the batter, preparing him for the imminent pitch.

BRIEF DESCRIPTION OF THE DRAWINGS

The stated objective of the invention and the manner in which it is achieved, as summarized hereinabove, will be more readily understood by reference to the following detailed description of the structure shown in the accompanying drawings wherein:

FIG. 5 is a fragmentary perspective view of a ball control mechanism for feeding balls in timed sequence to the throwing unit of the apparatus, parts being broken away to show interior structural details, FIGS. 5A, 5B and 5C are sequential views diagrammatically illustrating operation of the FIG. 5 mechanism, FIG. 6 is a fragmentary front elevational view of the ball throwing unit and an associated ball confining unit, as viewed along line 6—6 of FIG. 2.

DETAILED DESCRIPTION OF THE EXEMPLARY EMBODIMENT OF THE INVENTION

Figure 1:
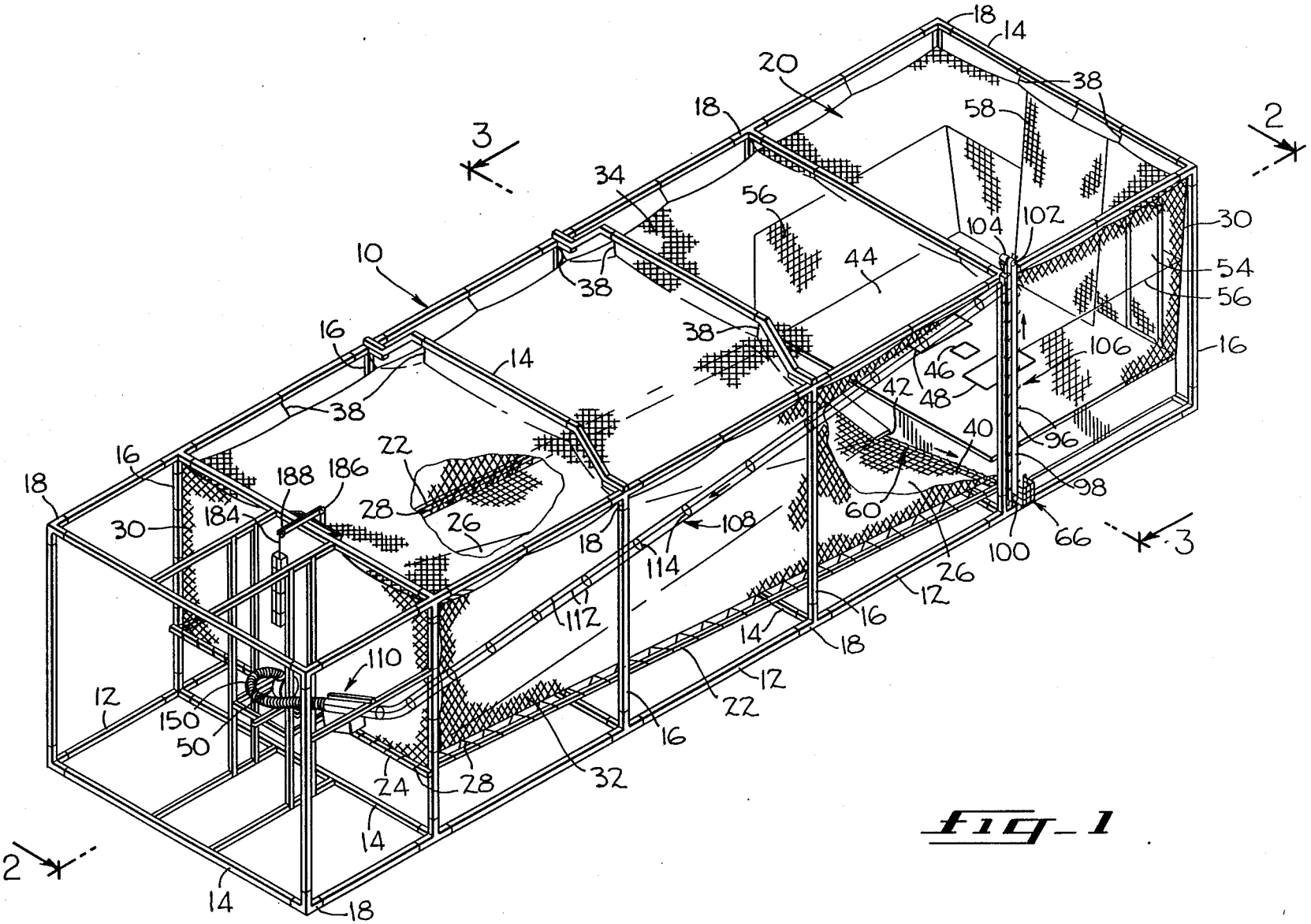
FIG. 1 is a perspective view of a batting practice apparatus constituting one embodiment of the present invention.

With initial reference to FIG. 1, the batting practice apparatus therein illustrated in an overall perspective view includes an exterior, generally rectangular, modular framework 10 which is formed by the simple assembly of frame members 12, 14, 16, preferably in the form of two-inch hollow rectangular tubing, that extend, respectively, longitudinally, transversely, and in an upright fashion, being joined at their extremities by frame couplers 18, each having four rectangularly-related sockets to receive the frame members 12, 14, 16 by a simple telescopic insertion. For reasons to become more apparent hereinafter, the simple telescopic insertion is all that is required, thus to facilitate the initial assembly and subsequent disassembly when desired, no bolting, welding, or other special connections being required for this exterior framework 10. If desired for certain batting activities, the central top transverse frame members can be bent upwardly to form a central arched configuration for the batting cage 20, to be supported within the framework 10, as will be described hereinafter.

The entire framework can be supported on the ground, a concrete or wooden floor, or any other reasonably level supporting surface, and need not be bolted or otherwise permanently secured to such surface, so that, again, the assembly or subsequent disassembly is facilitated.

Additionally, because the structure is formed in modular sections, a change, for example, from a softball batting practice apparatus to one for baseball, wherein a change in the throwing or pitching distance between the throwing unit and batting position is required, simply entails the addition of but another modular section. For example, for softball the overall dimensions of the framework 10 are approximately fifty-four feet in length, to accommodate the standard pitching distance of forty-five feet, thirteen feet in height, and approximately fourteen feet in overall width, so that the entire structure can be accommodated in relatively closely confined quarters such as an existing gymnasium, and at any exterior location no more than sixty feet in length and twenty feet in width for softball, and an additional ten feet in length for conventional baseball practice wherein the distance from the pitcher to the batter is standardized at sixty feet.

Additional side frame members 22 are secured by removable bolts interiorly of the opposite upright frame members 16 so as to slope downwardly from a position adjacent the throwing end of the frame towards a position spaced inwardly from the opposite end of the frame, where the batter is positioned, as will be described in detail hereinafter. These frame members 22 are bolted so as to descend at approximately a ten percent slope from a transverse frame member 24 which bridges the inclined side members 22 at their higher ends.

These three frame members 22, 24 are connected to and support a sloping bottom 26 of the mentioned batting cage 20, which is preferably formed by open netted material of nylon or other material having flexibility and resiliency. More particularly, suitable lacing 28 is wound in a generally helical configuration around the side and end frame members 22, 24 and the edges of the adjacent net so as to support the same therewithin at a spaced distance, the resiliency of the netting generating a slight inward pull on these frame members. Additional netting rises along the sides and both ends of the framework 10 and across the top, to form end walls 30, side walls 32, and a top 34, to complete the enclosed batting cage, which is thus formed substantially entirely of resilient, flexible material. Both ends of the framework 10 are similarly secured interiorly of the frame by suitable connecting cords 38, so that all of the flexible resilient netting is supported within the interior of the framework 10 so as to exert an inward pull on all frame members to maintain them in their assembled relationship within the frame couplers 18, thus allowing the substantial elimination of bolted connections, as previously mentioned, and at the same time providing the desired degree of tautness of the netting material of the batting cage 20 itself. It will also be observed that since the batting cage 20, formed by the flexible resilient netting, is supported interiorly of the rigid exterior framework, any ball batted within the batting cage will be substantially restricted to contact with a flexible resilient net, which will minimize any damage to the batted ball, and dampen any rebounding thereof.

The netting, and in particular the netting in the bottom 26 of the batting cage 20, is substantially smaller than the diameter of a softball or baseball. More particularly, since a softball has an approximate diameter of three and three-quarter inches, and a baseball approximately two and three-quarter inches, the openings in the nets should be less than one and three-quarter inches, and preferably no more than one and one-half inches. Thus, not only will a ball be restricted from passing through the net but if it lies on the bottom 26 of the batting cage 20, it will roll freely thereacross down the described ten percent slope. A lesser slope of perhaps eight percent can be tolerated but must be sufficient to allow the free rolling motion of the ball along the bottom 26 of the batting cage 20. It may be mentioned that if a ball is temporarily stopped or moving slowly on the bottom of the cage, an additional ball striking the resilient netting will effect flexure and vibration of the netting, which will serve to accelerate motion of the ball down the slope of the batting cage 20.

Figure 3:
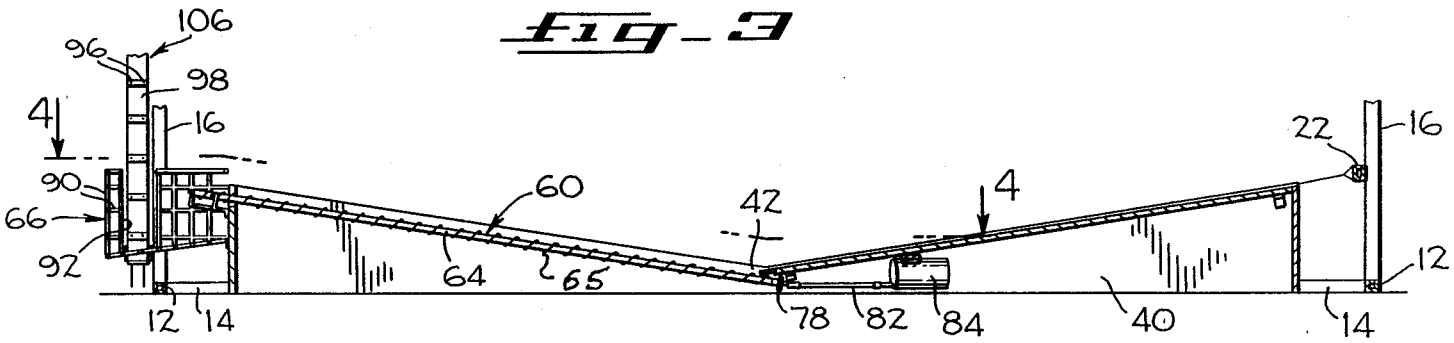
FIG. 3 is a fragmentary transverse sectional view taken along line 3—3 of FIG. 1.

At its lowermost end, the sloped netting of the cage bottom 26 is suitably secured to a transverse panel 40 at angles to provide a transverse slope from both sides of the cage 20 inwardly toward a central ball receiving opening 42, as best illustrated in FIG. 3. The ball receiving opening 42, as will be explained in more detail hereinafter, need be positioned no more than nine inches above the supporting surface, enabling the opposite end of the net cage bottom to be positioned no more than forty-five inches above such supporting surface and yet still attain the desired ten percent slope in a softball unit wherein the entire length of the bottom of the cage 20 need be no more than thirty feet.

Immediately beyond the lowermost end of the batting cage bottom 26, a flat platform 44 is disposed within the batting cage 20 to define "home plate" by suitable markings 46 on the platform together with suitably marked batters' boxes 48 on either side thereof Since the lowermost end of the cage bottom 26 can be no more than nine inches above the supporting surface, and the opposite end thereof no more than forty-five inches to achieve the desired slope, the ball throwing unit 50, which will be described hereinafter, can be positioned at a relatively low level and the elevation of the batter's platform, in turn, need be no more than eighteen inches above the supporting surface. Thus, in summary, the entire height of the structure is minimized so that it can be more readily adapted to confined interior spaces The ball throwing unit 50 is positioned on the framework 10 beyond the end wall 30, opposite the batter's platform 44, at the desired distance from home plate 46, and a small opening 52 in the wall allows the balls to be thrown therethrough to a batter in one of the batters' boxes 48. The batter gains access to the batter's position through a pivoted door 54 formed by heavy wire mesh in a rectangular frame in the adjacent end wall 30. Preferably, heavy wire mesh 56 is also positioned in the end wall 30 and the side walls 32, surrounding the batter's platform 44, to an intermediate height of approximately four feet, to protect viewers from an accidental throwing of a bat. Additionally, it is preferred to place a pitchback unit 58 composed of taut resilient nylon netting within an upwardly angled frame immediately behind "home plate" so that any missed or foul balls will be automatically returned to the cage bottom 26 for recycling.

When a ball is thrown from the throwing unit 50 and is batted by the batter, it will contact one surface of the batting cage 20, its force being dampened by the engaged netting, and will drop onto and roll down the sloping bottom 26 of the cage, thus to ultimately drop through the ball receiving opening 42.

Figure 4:
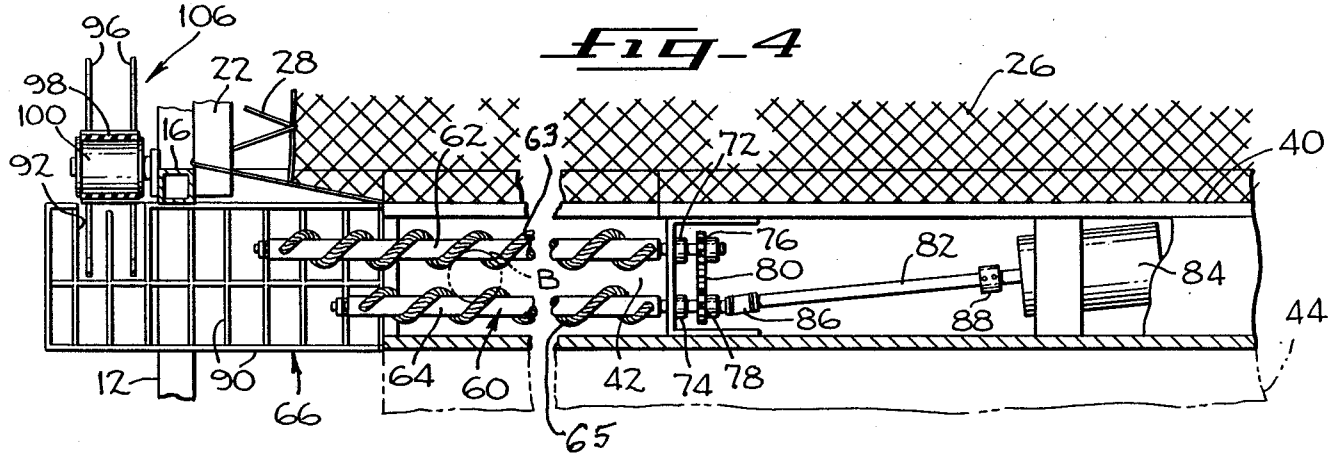
FIG. 4 is a fragmentary sectional view taken along line 4—4 of FIG. 3.

Beneath the ball receiving opening 42 a special form of ball conveyor 60 is mounted and, as best shown in FIGS. 3 and 4, includes a pair of shafts 62, 64 which extend in parallelism from a position centrally under the lowermost position of the cage bottom 26 outwardly and at a slightly upwardly inclined disposition to terminate above a ball hopper 66,the transverse slope of the cage bottom 26 allowing for this slight upward inclination of the shafts. Cords 63, 65 are helically wound on the two shafts 62, 64 (or may be formed integrally therewith) in the same direction and with equal pitch greater than a ball diameter. The shafts 62, 64 are mounted in suitable bearings 72, 74 at their extremities, and mount at their inner extremities like sprockets 76, 78 joined by a sprocket chain 80 so that the rotation of the two shafts is equalized. The shafts 62, 64 are driven by a shaft 82 connected to a small electric motor 84 by two small universal connections 86, 88 so that the motor can be supported under the remote section of the bottom 26 at a point where its lateral dimensions can be accommodated, yet permit the entire bottom of the cage 20 to be at its desired low elevation.

The mentioned hopper 66 is supported below the outer end of the lateral conveyor 60, being suitably mounted on one of the upright frame members 16 so as to extend therebeyond. The hopper 66 is formed by a grid of spaced bars 90 which extend both horizontally and vertically at a spacing which will permit balls to be supported therein, and, as clearly shown in FIG. 3, the bars at the bottom slope downwardly so that balls dropped into the hopper 66 will gravitate towards the outermost end thereof.

Adjacent the outermost end of the ball hopper 66, the bars 90 are broken away along one side of the hopper to provide parallel vertical slots 92 which accommodate pairs of upwardly curved fingers 96 projecting at intervals from an endless belt 98, which is mounted on suitable rollers 100, 102 at the bottom and top of the frame member 16. These rollers 100, 102 are driven by a suitable motor 104 so that the fingers 96 passing through the vertical slots 92 move upwardly, thus to elevate a single ball at a time upwardly, the next pair of fingers 96 in turn picking up the next ball from the hopper 66, thus to form a sequential ball elevator 106.

After reaching the top of the ball elevator 106, the fingers 96 pass over the uppermost roller 102, to thus deposit a ball carried thereby into the uppermost end of a ball conveying chute 108, which is positioned preferably adjacent the very top of the framework 10, as best shown in FIG. 1. The chute 108 extends downwardly along a slope sufficient to allow gravitational motion of the balls therealong to a ball control means 110 which controls feeding of individual balls in sequence to the mentioned ball throwing units, both of which will be described hereinafter. Preferably, the chute 108 is formed by a plurality of parallel rigid rods 112 held by exterior braces 114 at intervals on the frame to accommodate the balls for the described gravitational motion, thus allowing complete gravitational motion of the balls from the elevator 106 to the ball control means 110 without any additional powered conveyors.

The chute 106 delivers the balls to the ball control means 110 which, in accordance with the present invention, takes the form of a pair of spaced gates 112, 114 which are positioned at an interval of approximately one ball diameter. As clearly shown in FIG. 5, the gates 112, 114 take the form of bent plates whose extremities can pass through slots 116,118 in a flat plate 120 at the described interval. The first gate 112 encountered by the balls is supported on a transverse pivot pin 122 and is urged by a coiled spring 123 in a normally open position so as not to project upwardly through its adjacent slot 116, whereas the second gate 114 is supported on a pivot pin 124 so as to be urged upwardly into a ball blocking position by another and stronger spring 126. Thus, when in their normal inactivated dispositions, the gates assume the position shown in the operational diagram of FIG. 5A, so that a series of accumulated balls B will rest against the second gate 114 in adjacent contacting relationship.

To activate the gates 112, 114 to release a single ball, a crank arm 128 is rigidly secured to the pivot pin 122 for the first gate 112 and is pivotally joined at its extremity to one end of a link 130 which is pivotally joined at its opposite extremity to a pivoted link 132 which is connected to the second gate 114. A pivoted actuating arm 134 depends from the gate interconnecting link 130 downwardly to a cam follower 136 in the form of a pivoted lever which is supported on a fixed shaft 138 and is adapted for engagement by a roller cam 140 mounted on the side of a large sprocket 142, which is mounted on a cam shaft 143 and driven by a sprocket chain 144 connected to a smaller sprocket 146 on the output of a small motor 148 with a speed reducer so that the large sprocket 142 is rotated, preferably at a rate of approximately eight revolutions per minute, in the direction of the arrow A in FIG. 5.

When the cam engages the follower lever 136, the lever is pivoted downwardly from the position shown in FIG. 5 and FIG. 5A, to initially pull the crank arm 128 on the first gate 112 and urge the same upwardly so that it assumes a position between the first and second balls on the plate 120, as clearly illustrated in FIG. 5B. Continued downward motion of the cam follower lever 136 can cause no further motion upward of the first gate 112 since it engages the under side of the plate 120, as shown in FIG. 5B, and such motion therefore is transferred by the gate interconnecting link 130 to the second gate 114, which is then pulled downwardly to the position shown in FIG. 5C, whereupon a single ball B can be released. It should be noted that because of the interconnection of the two gates 112, 114, it is impossible for both gates to be open at the same time, and inadvertent release of more than one ball is precluded. The single released ball B can then roll under gravitational action through a flexible chute 150 to feed the ball throwing unit 50, which, as previously indicated, is preferably in the form of the throwing machine shown in my prior U.S. Pat. No. 4,195,614.

The ball throwing unit 50 is mounted substantially centrally of the net end wall of the batting cage adjacent the opening 52 in such end wall, which is sufficiently large to enable pivotal adjustment of the throwing unit in either a vertical or horizontal direction through the mechanism described in my prior patent, so that further details thereof are not recited herein. Balls can be thrown in timed sequence, approximately one every seven seconds, by the ball throwing unit 50, fed by the previously described ball control means 110, to the batter. If desired, the unit 50 can be adjusted vertically or horizontally to change the precise positioning of the ball; and since the described throwing unit also includes a speed control mechanism adjustments can be made, for example, for fast or slow pitches, as desired, again the dimensions of the opening in the net end wall permitting various desired trajectories of the thrown ball.

Figure 2:
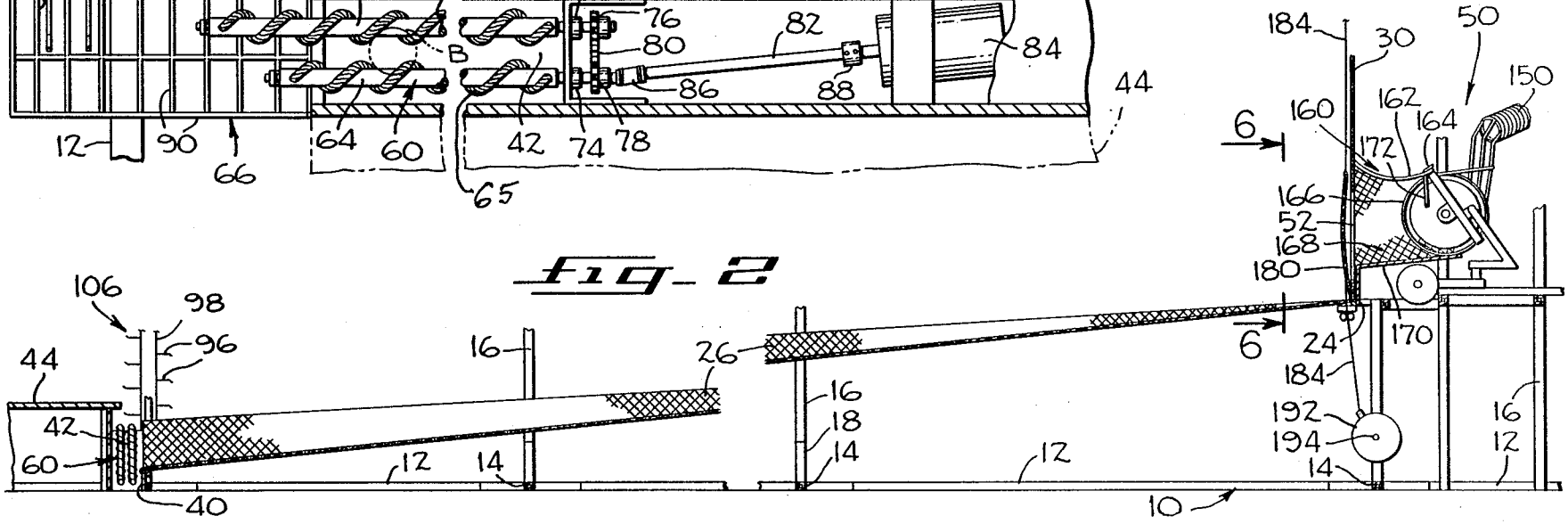
FIG. 2 is a fragmentary longitudinal sectional view of the apparatus, taken along line 2—2 of FIG. 1.

Even though the opening 52 in the end wall 30 is relatively small, it is of course possible that a batted ball could pass therethrough to engage the throwing unit 50, to cause damage to it or the ball, and in extreme cases even provide for a repeat and unexpected throwing of the ball. As a consequence, as best shown in FIGS. 2 and 6, a ball confining means 160 is connected to the end wall 30 around the opening 52 and around the throwing unit frame. A flexible belt 162 is attached by a clamp 164 to the protective guard 166 of the throwing unit frame, and is lashed to the net above the opening 52. In turn, side netting 168 is secured by lashing to the outer edges of the opening in the end wall net, to the described flexible belt 162 at the top, and to a bottom plate 170 flexibly attached below the opening 52 and slidably to the unit guard 166, so as not to interfere with any adjustment of the elevation of the ball trajectory. The bottom plate 170 slopes toward the batting cage so that any balls in the confining means will be returned by gravity to the cage. In addition, a barrier bar 172, which is best shown in FIG. 6, is supported from the clamp 164 to extend downwardly in front of the upper portion of the throwing unit 50 so that a ball is precluded from being rethrown to the batter.

Figure 7:
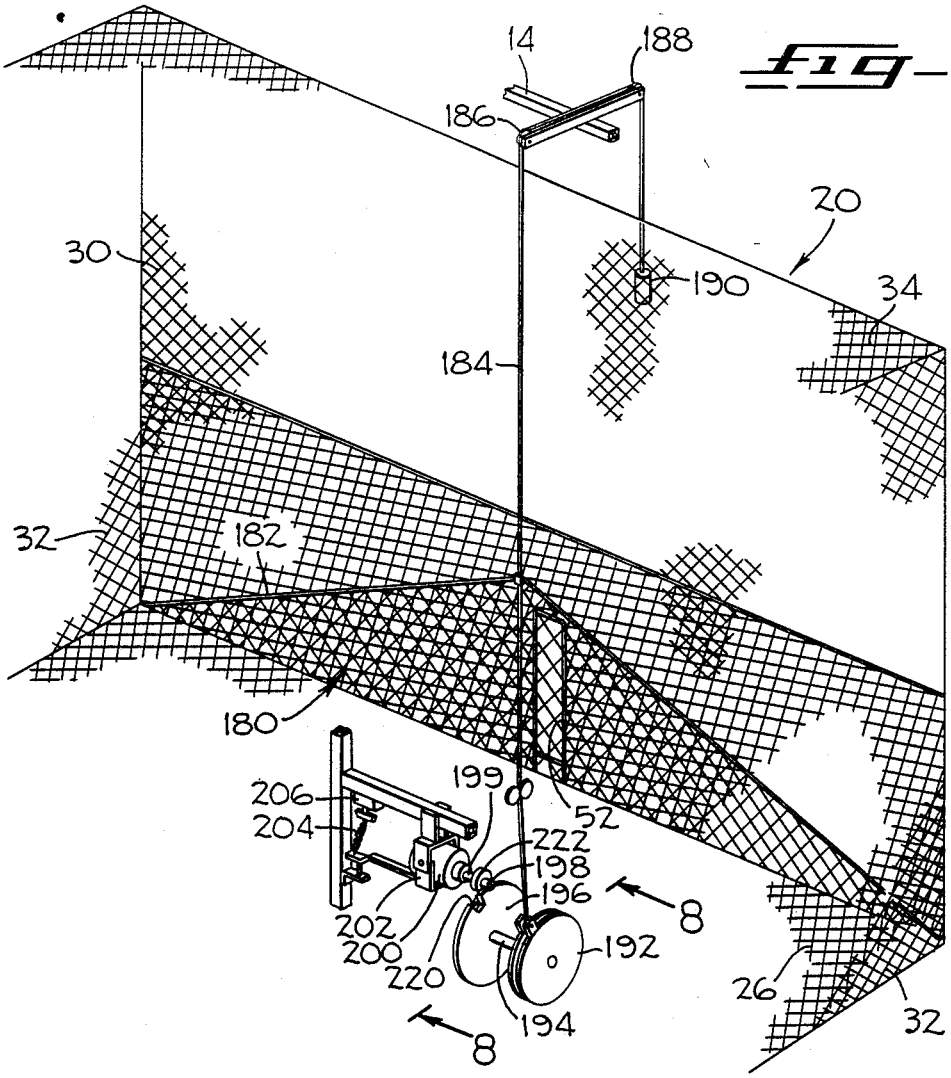
FIG. 7 is a fragmentary perspective view of a ball screening mechanism adjacent the ball throwing unit.
Figure 8:
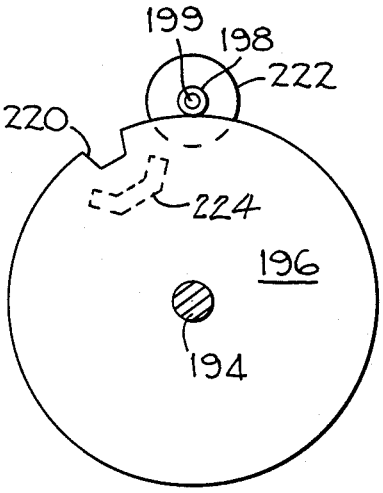
FIG. 8 is an enlarged, fragmentary elevational view taken along line 8—8 of FIG. 7, illustrating structural details.

If re-entry of a batted ball through the ball throwing opening 52 is to be absolutely prevented, a protective screen 180 can be placed thereover, as shown in FIG. 7, and preferably takes the form of a triangular section 182 of netting whose bottom edge is secured to the juncture of the bottom 26 and end wall 30 of the batting cage 20, so that its apex lies above the opening 52 and is secured to a cord 184 which extends upwardly through the top of the cage 20, and thence over two pulleys 186, 188 mounted on the framework 10 and downwardly where it mounts a weight 190 that normally will hold the protective screen in the illustrated disposition, covering the opening 52. To enable lowering of the screen 180 preparatory to the throwing of a ball, the cord 184 is connected to the perimeter of a circular plate 192 mounted on a shaft 194, which also mounts a drive wheel 196 which is adapted for engagement by a driving roller 198 on the shaft 199 of a motor 200. Such motor 200 can pivot on a suitable pivotal bracket 202 to bring the roller 198 into contact with the drive wheel 196. Such motor 200 operates continuously but will normally be held by a spring 204 in a pivotal position such that the roller 198 does not engage the drive wheel 196 and will only come into such contact when the motor 200 is pivoted by its operative connection to a small solenoid 206. The solenoid 206, in turn, is energized in timed relationship to the throwing of a ball by a cam-actuated microswitch 208 (see FIG. 5), mounted adjacent a rotary cam 210 that is secured on the same shaft 143 with the previously described ball control sprocket cam 140. The microswitch 208 is normally open, but when the appropriate rotation of the cam 210 occurs shortly prior to the release and throwing of a ball, it is closed to energize the solenoid 206 and thus temporarily lower the protective screen 180.

The lowering of the screen 180 is controlled by a limited drive mechanism including a notch 220 formed at a predetermined position on the drive wheel 196 into which notch the drive roller 198 drops after predetermined drive wheel rotation. A freely rotatable bearing 222 drops into engagement with a V-block 224 on the side of the drive wheel 196 at the same time to preclude contact of the drive roller 198 with the notch surface. Thus, even if the roller 198 continues to rotate, no further rotation of the drive wheel occurs and the screen withdrawal is limited.

Continued rotation of the cam 210 allows the microswitch 208 to open, thus de-energizing the solenoid 206 so that the drive roller is lifted from the notch 220 and no further power is delivered to the drive wheel 196, and the weight 190 can return the screen 180 to its opening covering position.

An additional double cam 212 mounted on the same cam shaft 143 is arranged to actuate a second microswitch 214 which, in turn, is thus correlated in time with the throwing of a ball so as to generate in timed sequence an audio or visual signal mounted adjacent the throwing unit shortly prior to the actual throwing.

The electrical connections to the described motors and solenoids, being conventional, are not shown; and the control box for all of the elements can be mounted adjacent the throwing unit 50 so that a single operator can control the trajectory and speed of the balls, the time interval between the pitches, and of course turn the machine on and off when desired.

When the unit is turned off, a third cam 230 on the cam shaft 143 maintains a parallel circuit operative through a microswitch 232 so that the entire gate and signal control mechanism is returned to a position immediately after one ball has been thrown, so that the same signals and throwing cycle are commenced when the unit is re-energized.

While not shown, a coin control mechanism can be incorporated in such control box or any other location, and no attendant would then be necessary whatsoever, the prospective batter merely placing the desired coins in the control unit to actuate throwing of a predetermined number of pitches for practice purposes.

It will be clear from the foregoing description that the apparatus is essentially self-contained, requiring only an exterior electrical connection. With the use of a conventional generator, even this exterior connection can be eliminated. In summary then, one or more of the units can be utilized as required in a particular location.

Various modifications will be apparent to those skilled in the art. For example, if an existing enclosure is to be utilized, a resilient sloping net bottom can be installed therein together with the ball throwing unit and the ball recycling conveyors and ball control units, to utilize many of the inventive concepts described herein.

Obviously, many further modifications and/or alterations other than those suggested hereinabove can be made without departing from the spirit of the invention, and the foregoing description of one embodiment is accordingly to be considered as purely exemplary, and not in a limiting sense, and the actual scope of the invention is to be indicated only by reference to the appended claims.

What is claimed is:

1. Batting practice apparatus which comprises a movable open framework including an assembly of longitudinal, transverse, and upright frame members adapted to be placed and supported on a supporting surface, a batting cage supported interiorly of and spaced from said framework an amount sufficient to preclude any batted ball from contacting any of said frame members and including a top, bottom, side walls and end walls composed substantially entirely of a flexible material connected at all their edges to said frame members to exert an inward pull on said frame members, said bottom being of resilient material and supported above the supporting surface to slope toward a lowest point only sufficiently so that batted balls will move by gravity and cause flexing of said material toward said lowest point, the support of said bottom from said framework being arranged around the perimeter to create a taut support of said resilient flexible material, means defining a batter's position adjacent one end of said batting batting cage, and means adjacent the opposite end of said batting cage for throwing a ball to the batter's position.

2. Batting practice apparatus according to claim 1 wherein said longitudinal, transverse, and upright frame members are telescopically received in rectangularly-related sockets in a plurality of frame member couplers.

3. Batting practice apparatus according to claim 1 wherein said batting cage material is resilient and said top, bottom, side walls and end walls are connected at their edges to one another.

4. Batting practice apparatus according to claim 1 wherein said bottom also slopes transversely toward the center thereof.

5. Batting practice apparatus according to claim 4 wherein the bottom of said cage slopes longitudinally and transversely to a lowest position slightly above a supporting surface for said framework.

6. Batting practice apparatus which comprises a batting cage including a top, bottom, side walls and end walls defining an enclosure, a raised platform adjacent one end of said cage defining a batter's position, means adjacent the opposite end of said cage for throwing a ball, means forming a ball-receiving opening in the bottom of said cage adjacent said platform, the bottom of said batting cage sloping toward said opening, means for returning received balls to said throwing means including a sloping ball conveyor for receiving balls from said opening to convey the balls in sequence to a position laterally beyond said batting cage wherein said sloping ball conveyor includes a pair of substantially parallel rotatable shafts having cords wound helically thereon, and means for rotating said shafts in unison.

7. Batting practice apparatus according to claim 6 wherein said sloping ball conveyor includes cords having a helical pitch greater than the diameter of the ball.

8. Batting practice apparatus according to claim 6 wherein said ball returning means also includes a ball elevator arranged to receive and elevate balls in sequence to a level above said ball-throwing means, and a ball chute arranged to receive balls from said elevator for gravitational delivery to said ball-throwing means.

9. Batting practice apparatus according to claim 8 which comprises means in said ball chute for controlling the feeding of individual balls to said throwing means.

10. Batting practice apparatus according to claim 9 which comprises means connected to said ball control means for signalling the imminence of a thrown ball.

11. Batting practice apparatus according to claim 9 wherein said ball control means includes a pair of gates movable separately into ball blocking position in said chute, and means periodically operative to move one gate into blocking position and thereafter to move the other gate out of blocking position.

12. Batting practice apparatus according to claim 11 which comprises means interconnecting said gates in a fashion such that only one gate can be open at any one time.

13. Batting practice apparatus according to claim 6 which comprises a pitch-back unit composed of taut resilient material supported within one end wall behind the batter's position on said platform.

14. Batting practice apparatus according to claim 6 wherein said ball throwing means is located adjacent one of said end walls outside of said enclosure, and said end wall material has an opening through which balls may be thrown.

15. A ball conveyor according to claim 6 wherein said cords have a pitch slightly greater than the diameter of a ball.

16. Batting practice apparatus which comprises an open framework, a batting cage supported interiorly of the framework and including top, bottom, side walls and end walls composed substantially entirely of a flexible material, means defining a batter's position adjacent one end of said batting cage, means outside of said cage adjacent the opposite end of said batting cage adjacent one end wall for throwing a ball to the batter's position, said one end wall having an opening through which balls may be thrown, a flexible protective screen movable into and out of position over the opening in said end wall, and means operative in response to initiation of a ball throwing operation to move said screen out of position over the end wall opening.

17. Batting practice apparatus according to claim 16 which comprises means operative immediately subsequent to the throwing of a ball to move said screen into position over the end wall opening.

18. Batting practice apparatus which comprises a batting cage including a top, bottom, side walls and end walls defining an enclosure, a raised platform adjacent one end of said cage defining a batter's position.

means outside the cage adjacent the opposite end of said cage adjacent the end walls for throwing a ball, said end wall materials having an opening through which balls may be thrown, a flexible protective screen movable into and out of the position over said opening, limited drive means connected to said screen to move said screen a predetermined distance out of position over said opening, means forming a ball receiving opening in the bottom of said cage adjacent said platform, the bottom of said batting cage sloping towards said opening, and means for returning received balls to said throwing means.

19. Batting practice apparatus according to claim 18 wherein said limited drive means includes a motor having a drive shaft, a drive roller on said drive shaft, a freely-rotatable member on said drive shaft, a drive wheel engageable by said drive roller and having a notch therein, an indented block on the side of said drive wheel, radially aligned with said notch and engageable by said freely-rotatable member, and means operable to move said drive roller into engagement with said drive wheel.

* * * * *